United States Patent [19]

Weller

[11] Patent Number: 4,949,514

[45] Date of Patent: Aug. 21, 1990

[54] RAIN GUTTER LINER

[76] Inventor: Kip D. Weller, 121 Skunk Misery Rd., Higganum, Conn. 06441

[21] Appl. No.: 444,290

[22] Filed: Dec. 1, 1989

[51] Int. Cl.[5] ..... E04D 13/00
[52] U.S. Cl. ..... 52/12; 210/474
[58] Field of Search ..... 52/11, 12; 210/474

[56] References Cited

U.S. PATENT DOCUMENTS

| | | | |
|---|---|---|---|
| 1,597,503 | 8/1926 | Andrews | 52/12 |
| 2,419,996 | 5/1947 | Honikman | 52/12 |
| 3,507,396 | 4/1970 | Homa | 52/12 X |
| 3,855,132 | 12/1974 | Dugan | 52/12 X |

FOREIGN PATENT DOCUMENTS

| | | | |
|---|---|---|---|
| 1509127 | 8/1969 | Fed. Rep. of Germany | 52/12 |

*Primary Examiner*—Carl D. Friedman
*Attorney, Agent, or Firm*—Chilton, Alix & Van Kirk

[57] ABSTRACT

A liner for a rain gutter and the like comprises a body of porous solid material which is installed in the gutter to form an upper barrier surface. The barrier surface has a plurality of undulations. Longitudinally extending projections at the side portions of the body function as sealing structures to seal the liner with the gutter side walls. The liner and gutter form a lower longitudinally extending liquid passageway. Liquid passes through the liner to the passageway while solid debris remains on the upstream of the side of the barrier surface.

20 Claims, 2 Drawing Sheets

RAIN GUTTER LINER

BACKGROUND OF THE INVENTION

This invention relates generally to open trough-type gutters. More particularly, this invention relates to devices employed for preventing foreign matter from interrupting or blocking the flow of liquid through a rain gutter system.

It is well recognized that trough-type rain gutters which are mounted at the edges of a roof are susceptible to clogging with foreign debris such as leaves, paper scraps, dirt and other material. Over a period of time, the debris collects in sufficient quantities to ultimately clog and interrupt the liquid flow through the gutter system thereby resulting in water overflow, plugging of downspouts and other adverse effects to both the integrity of the surrounding structures and the functioning of the gutter system. The susceptibility to clogging requires periodic maintenance of the gutter system. Maintenance of the gutter system is compounded by the height and often relatively inaccessible location of the gutters.

A number of devices have been advanced to alleviate the problems of gutter clogging. One type of such a device involves the mounting of screens or covers to the open, upper portion of the gutter so as to prevent leaves and foreign debris from entering the gutter and the fluid passageway of the gutter system. One of the drawbacks to the screen-type devices is that over a period of time, the leaves and foreign matter collect on the devices in sufficient masses that the rain water flow to the gutter is completely interrupted or diverted by the collected masses. Consequently, the screen-type devices also require that there be periodic cleaning or maintenance of the screens to ensure proper operation of the gutter system.

Gutter liner systems and mechanisms for facilitating maintenance of gutter systems of various configurations have also been advanced. Generally, such conventional devices are difficult to install, are relatively expensive and tend to be susceptible to malfunction under constant exposure to the elements.

U.S. Pat. No. 3,855,132, entitled "Open Trough Filler", discloses an open trough such as a rain gutter with a reticulated porous foam material conformably positioned within the gutter. The foam material has a myriad of labyrinthine passages through which the liquid carried by the gutter can flow. The foam material also serves as a barrier to solid foreign matter which would otherwise enter and clog the liquid passageways. The porous solid filter element in one disclosed embodiment substantially entirely occupies the volume of the rain gutter. A second disclosed embodiment defines a passageway between the filler and the bottom wall of the rain gutter.

Other devices which generally relate to the subject matter of the invention are disclosed in the following references:

| Patentee | U.S. Pat. No. |
|---|---|
| E. Kreutzberg | 956,372 |
| W. R. Schmitz, Jr. | 2,533,402 |
| L. A. McLean | 3,053,393 |
| R. Homa | 3,507,396 |
| J. M. Cunning | 4,272,370 |
| W. T. Good et al | 4,406,093 |

-continued

| Patentee | U.S. Pat. No. |
|---|---|
| W. L. Axford | 4,551,956 |
| K. V. Pepper | 4,553,356 |
| C. Smith | 4,590,716 |
| J. S. Pedgonay | 4,644,704 |
| R. W. Butler | 4,741,645 |

SUMMARY OF THE INVENTION

Briefly stated, the invention in a preferred form is a liner adapted for installation in a trough-type rain gutter. The liner includes an elongated integral body of porous solid material dimensioned for positioning within the gutter. The body comprises an upper barrier surface and a pair of opposing side portions which cooperate to define a generally longitudinally extending lower liquid passageway. The barrier surface is configured with a plurality of undulations. Sealing structures in the form of longitudinally extending lips project from the side portions for sealing the body with the gutter side walls. The gutter and installed liner are positioned to receive a run-off stream comprising liquid and solid debris components which impinge the upper barrier surface from a generally upward location. The liner allows the liquid component to traverse through the body for flow through the passageway. The barrier surface functions as a barrier to the passage of the debris component. In a preferred embodiment, the undulations extend generally longitudinally in parallel relationship. Spacer members may be employed at longitudinally spaced locations along the gutter for spacing the side portions in the desired spacial relationship.

The liner in one embodiment comprises an elongated deformable sheet of porous solid material having opposed first and second surfaces. The first surface is configured with a plurality of ridges. The second surface defines a pair of transversely spaced notches which extend the longitudinal length of the sheet. At the installation site, the sheet is then folded at the notches and inserted into the rain gutter to form an inverted generally U-shaped configuration defining a longitudinal liquid passageway. Some of the ridges engage the side walls of the gutter while the other ridges define an upper surface extending between the gutter sidewalls. The notches are defined by pairs of intersecting surfaces which intersect at an angle less than 90°. The liner material is preferably a foam composition such as polyurethane.

The ridges may have substantially the same shape and are equidistantly transversely spaced to form a serrated surface. The ridges which constitute the upper barrier surface of the liner may project a greater distance than the ridges which are employed to seal against the side walls of the gutter.

An object of the invention is to provide a new and improved rain gutter liner to prevent clogging of the gutter passageways.

Another object of the invention is to provide a new and improved rain gutter liner which may be manufactured and marketed in an efficient and cost effective manner.

A further object of the invention is to provide a new and improved rain gutter liner of efficient construction which is easily installed in a rain gutter system and is effective in preventing foreign material from entering and clogging the gutter system without requiring significant maintenance.

A yet further object of the invention is to provide a new and improved rain gutter liner which may be manufactured and marketed in rolled sheet form and is easily transformable at the gutter site for installation in the gutter system.

Other objects and advantages of the invention will become apparent from the drawings and the specification.

DESCRIPTION OF THE PREFERRED EMBODIMENTS

Figure 1:
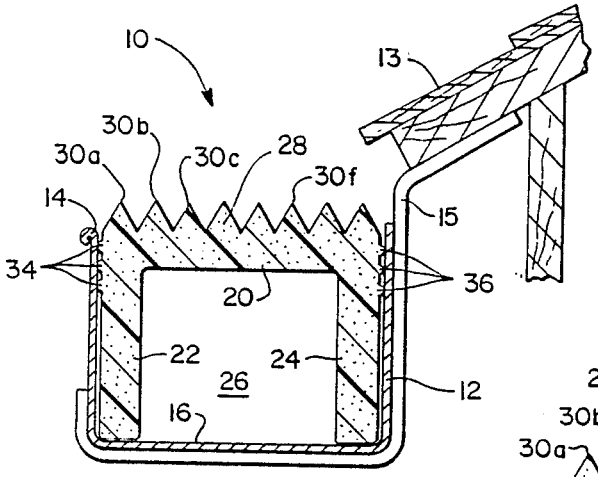
FIG. 1 is a cross-sectional view of a rain gutter and an installed liner in accordance with the present invention, said gutter and liner being illustrated in connection with the edge of a roof.
Figure 2:
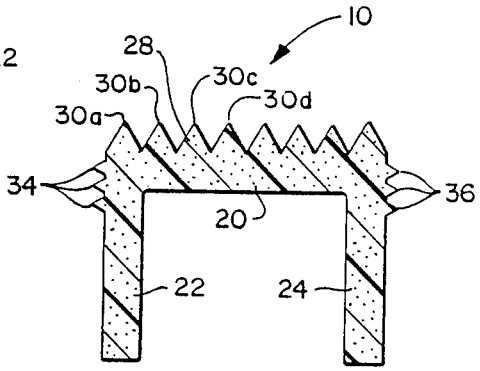
FIG. 2 is a cross-sectional view of a pre-installation configuration liner of FIG. 1.

With reference to the drawings wherein like numerals represent like parts throughout the figures, a rain gutter liner designated generally by the numeral 10 in FIGS. 1 and 2 is adapted for use in conjunction with a rain gutter designated generally by the numeral 12. Rain gutter 12 may assume any of a number of conventional forms. In the preferred application, gutter 12 essentially functions as a liquid conduit for collecting and conveying rain water or runoff from a structure such as a sloping roof 13 illustrated in FIG. 1. Gutter 12 has an elongated trough-like shape including an upper longitudinal open inlet 14 which conventionally receives the rain water or runoff (typically from a roof) and a lower longitudinal outlet passageway 16 which functions as the water conduit or sluiceway. The gutter 12 is suspended by conventional hangers 15. Naturally, other mounting or securing devices may be employed. In the illustrated embodiment, the rain gutter 12 has a conventional quasi-rectalinear configuration. It should, however, be appreciated that the invention is not limited to the specific gutter embodiment nor the structure and position illustrated in the drawings.

The liner 10 is an integral one-piece element having a reticulated porous foam-type composition which may be composed of polyurethane foam or other similar materials. The porous structure defines a multiplicity of tortuous passages through the liner which allow for the passage of liquid therethrough. The passages are sufficiently small that solid material, such as leaves, dirt, paper, etc., which ordinarily is conveyed with the rain water or runoff, cannot enter the liquid passageways. The liner 10 thus functions as a barrier to leaves and other solid debris.

The liner 10 is generally dimensioned to conform to the dimensions and shape of the corresponding gutter for which it is adapted as will be detailed below. The liner 10 may come in a wide range of lengths including a quasi-continuous roll form. One or more sections of the liner 10 are installed so as to preferably traverse the entire longitudinal extent of the collection portion of the gutter system.

The liner 10 preferably has a generally uniform cross-section comprising a primary barrier panel 20 and a pair of depending traversally spaced leg panels 22 and 24. The panels 20, 22 and 24 cooperate to define the liquid passageway 26.

The barrier panel 20 has an upper inlet surface 28 defined by a plurality of undulations 30*a*, 30*b*, 30*c* . . . which traverse the longitudinal extent of the liner. The upper inlet surface 28 defined by the undulations has a relatively large surface area per unit volume to provide for a highly efficient drainage rate through the liner. The inlet surface 28 is also highly resistant to clogging by foreign debris conveyed in the rain water or runoff. In addition, the undulations function as anti-splashing structures. The undulations may assume a uniform parallel sharp ridge or saw-tooth shape. It should be appreciated that the undulations 30*a*, 30*b*, 30*c*, etc. may be spaced, dimensioned and shaped in a wide variety of configurations.

The opposing side panels 22 and 24 in the illustrated embodiment extend at substantially right angles to the primary barrier panel 20. The side panels 22 and 24 essentially are shaped for quasi-conformal relationship with the rain gutter side walls and may assume a wide variety of configurations upon installation to the gutter. The preferred foam composition provides for a significant plastic deformation of the liner so that the shape of the gutter to a degree defines the shape of the installed liner. One or more longitudinally extending sealing lips 34 and 36 integrally project, respectively, from the side panels 22 and 24. The lips 34 and 36 are adapted to provide a compressive interface with the sides of the rain gutter to form a seal of relatively high integrity as illustrated in FIG. 1. The sealing lips 34 and 36 preferably are formed as integral projections from the liner body, although in some applications (not illustrated), a separate sealing strip may be employed for sealing between the sides of the gutter and the liner. The sealing lips principally function to seal against debris or solid material slipping and wedging between the gutter and the liner and becoming entrapped thereby.

Figure 3:
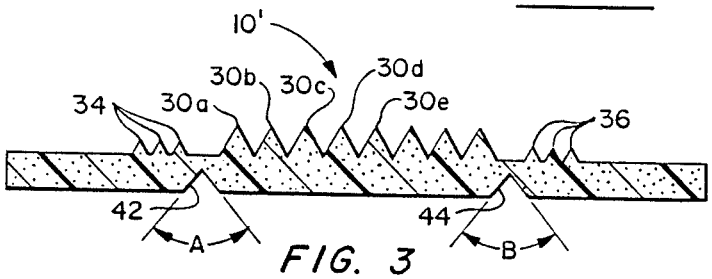
FIG. 3 is a cross-sectional view of a second pre-installation embodiment of a liner in accordance with the present invention.
Figure 4:
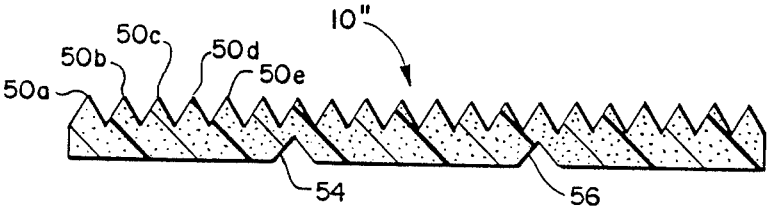
FIG. 4 is a cross-sectional view of a third pre-installation embodiment of a liner in accordance with the present invention.
Figure 5:
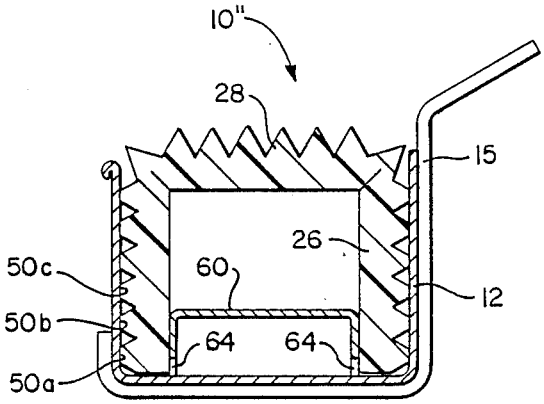
FIG. 5 is a cross-sectional view of a rain gutter and the installed liner of FIG. 3.

Although in a preferred form such as illustrated in FIGS. 1 and 2, the liner may be initially manufactured in the general shape assumed upon installation. In the preferred embodiment, the liner 10' is essentially formed in a quasi-continuous roll sheet form having a substantially uniform cross-section such as illustrated in FIGS. 3 and 4. The undulations 30*a*, 30*b*, and 30*c*, etc. and the sealing lips 34 and 36 are integrally formed on the top surface of the roll sheet. Longitudinally extending parallel notches 42 and 44 are formed in the bottom portion of the sheet to facilitate transforming the liner 10' to an installed configuration such as illustrated in FIG. 5. The notches are defined by intersecting planar surfaces. The intersection angles A and B are preferably less than 90° so that upon folding of the sheet along the longitudinal notches, the side panels 24 and 26 are urged against the gutter side walls by the engagement of each of the notch defining surfaces.

In another liner embodiment illustrated in FIGS. 4 and 5, the liner 10'' has an upper surface traversed by a plurality of adjacent uniform, parallel ridges 50*a*, 50*b*, 50*c* . . . Upon installation an intermediate set of the ridges functions as the undulations of upper surface 28. The remaining two sets of spaced ridges function as the sealing elements for the gutter side walls. A pair of parallel notches 54 and 56 are also formed in the opposing side to facilitate transformation of the liner 10'' to the installed mode.

An advantage of the liners 10' and 10'' having the sheet-like roll form of FIGS. 3 and 4 is that the size and the bulk of the packaging is substantially reduced. In addition, it should be appreciated that the liner need not occupy substantially the entire volume of the gutter in order to be effective. Thus, the quantity of material required for a given liner can be efficiently conserved without compromising either the intended function of preventing clogging of the gutter system or the installation efficiency.

Figure 6:
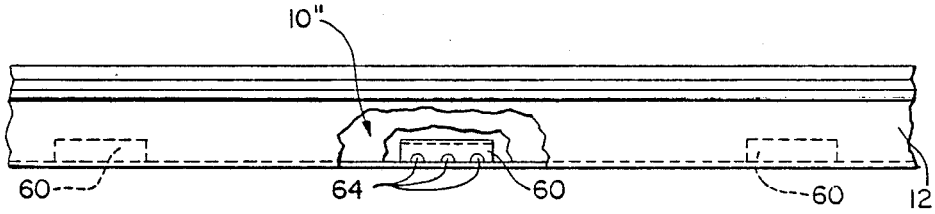
FIG. 6 is a front view, partially broken away and partially in section, illustrating the rain gutter and the liner of FIG. 5.

With additional reference to FIGS. 5 and 6, a plurality of spacer members 60 may be positioned at longitudinally spaced positions in the rain gutter. The spacer members 60 essentially stabilize and interiorly support the liner in the installed mode and also further function to urge the side panels 22 and 24 into sealing relationship with the gutter walls. The members 60 may be formed from a thin sheet of metal, plastic or other suitable material. The sheet is scored and folded to form a three-sided member which is inverted upon installation. Slots 64 may be formed at the lower edges of the members to provide for water flow from the adjacent liner portions to the central fluid passageway 26.

It will be appreciated that the described liners may be installed in an efficient manner in the collection portions of the gutter system. The gutter functions as an efficient and effective barrier to the passage of leaves and debris while allowing the liquid to pass through the liner to the gutter passageway 26. The debris is deposited on the upstream side of the upper liner inlet surface. Any material which collects on the inlet surface 28 is easily removed. The composite material of the liner is impervious to degradation upon exposure to the elements.

While preferred embodiments of the foregoing invention have been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A liner adapted for installation in a rain gutter having an open upper inlet comprising:

an elongated integral body of porous solid material dimensioned for positioning within a rain gutter, said body comprising an upper barrier surface and a pair of opposing side portions, and defining a generally longitudinally extending, liquid passageway disposed below said barrier surface;

a plurality of undulations traversing said barrier surface; and sealing means comprising a longitudinally extending structure projecting from said side portions for sealing said body with said gutter, so that when a run off stream comprising liquid and solid debris components impinges said upper barrier surface from a generally upward location, the liquid component traverses through the body for flow through said passageway and the barrier surface functions as a barrier to passage of the debris components.

2. The liner of claim 1 wherein said undulations extend generally longitudinally in parallel relationship.

3. The liner of claim 1 wherein said sealing means comprises at least two parallel longitudinally extending lips projecting from each side portion.

4. The liner of claim 1 wherein said side portions further define opposing inner surfaces and further comprising spacer means for engaging said opposing inner surfaces to maintain said side portions in spaced relationship.

5. The liner and spacer means of claim 4 wherein said spacer means further defines a plurality of slots.

6. The liner of claim 1 wherein said material is a foam composition.

7. The liner of claim 1 wherein said material is a polyethylene foam.

8. A liner adapted for installation in a rain gutter of a type having a generally trough-like configuration having side walls and an upper collection opening comprising:

an elongated deformable sheet of porous solid material dimensioned for installation in a rain gutter and having opposed first and second surfaces;

said first surface being configured with a plurality of ridges; and said second surface defining a pair of transversely spaced notches extending longitudinally along said sheet, so that said sheet may be folded at said notches and inserted in a rain gutter to form a generally inverted U-shaped configuration defining a longitudinal liquid passageway with some of said ridges engaging the side walls of said gutter and other ridges defining an upper surface disposed between said gutter side walls.

9. The liner of claim 8 wherein each said notch is defined by a pair of intersecting surfaces which intersect at an angle less than 90°.

10. The liner of claim 9 wherein said ridges have substantially the same shape and are generally equidistantly transversely spaced to form a serrated surface.

11. The liner of claim 8 comprising three ridge arrays with the first array being disposed between said other two arrays and projecting generally a greater distance relative to said second surface than said second and third arrays.

12. The liner of claim 8 wherein said material is a foam composition.

13. The liner of claim 8 wherein said sheet has a generally uniform cross section throughout its longitudinal extent.

14. A gutter system comprising:

collection means comprising longitudinally extending side walls, a bottom wall and an upper opening for collecting a liquid; and liner means installed in said collection means for forming a barrier to the entry of solid material into said collection means, said liner means comprising a porous solid body defining a plurality of tortuous liquid passages, said body comprising:

barrier section means having an upper surface defined by a plurality of undulations, said upper surface disposed generally between said side walls;

first and second side portions depending from said barrier section means and engaging said side walls;

said body defining with said bottom wall a longitudinal liquid passageway.

15. The gutter system of claim 14 further comprising sealing means projecting from said side portions and engageable with said side walls for sealing said liner means with said side walls.

16. The gutter system of claim 14 wherein said undulations comprise a plurality of parallel ridge-like structures.

17. The gutter system of claim 16 wherein said structures are substantially identical and generally equidistantly spaced.

18. The gutter system of claim 14 wherein said upper surface is generally positioned proximate the upper opening of said collection means and portions of said liner means side portions engage said bottom wall.

19. The gutter system of claim 14 further comprising a plurality of spacers disposed and dimensioned to engage between said side portions and mount against said bottom wall.

20. The gutter system of claim 18 wherein said spacers define a plurality of slots to permit the passage of liquid from said body to said longitudinal passageway.

* * * * *